US005791888A

United States Patent [19]

Smith

[11] Patent Number: 5,791,888

[45] Date of Patent: Aug. 11, 1998

[54] STATIC SEAL FOR ROTARY VANE CARTRIDGE PUMP ASSEMBLY

[76] Inventor: Clyde M. Smith, 6101 Hickory Valley Rd., Nashville, Tenn. 37205

[21] Appl. No.: 778,690

[22] Filed: Jan. 3, 1997

[51] Int. Cl.[6] ..... F04C 2/344; F04C 15/00

[52] U.S. Cl. ..... 418/149; 418/259

[58] Field of Search ..... 418/70, 133, 149, 418/259

[56] References Cited

U.S. PATENT DOCUMENTS

| | | | |
|---|---|---|---|
| 3,193,190 | 7/1965 | Lindberg | 418/149 |
| 3,194,122 | 7/1965 | Kee | 418/149 |
| 3,295,262 | 1/1967 | Brown | 418/149 |
| 3,583,838 | 6/1971 | Stauber | 418/45 |
| 3,806,286 | 4/1974 | Granberg | 418/173 |
| 3,966,369 | 6/1976 | Garrison | 418/149 |
| 5,324,184 | 6/1994 | Morey | 418/149 |
| 5,411,386 | 5/1995 | Huber et al. | 418/149 |

FOREIGN PATENT DOCUMENTS

| | | | |
|---|---|---|---|
| 1428151 | 3/1964 | Germany | 418/259 |

*Primary Examiner*—John J. Vrablik

*Attorney, Agent, or Firm*—Fitzpatrick, Cella, Harper & Scinto

[57] ABSTRACT

A rotary vane pump includes a cartridge with a sleeve enclosing a set of rotary vanes on a shaft and end members supporting the shaft. A low pressure inlet to the vanes is formed in one side of each end member and a high pressure outlet from the vanes is formed in the other side of each end member. A pair deformable strips are affixed in grooves in the exterior surface of the cartridge which extend in an axial direction at positions that separate the low pressure inlet side from the high pressure outlet side. The cartridge is inserted into a housing having a fluid inlet port and a fluid outlet port to establish a first path between the fluid inlet port of the housing and the low pressure inlet of the cartridge and a second path between the high pressure outlet of the cartridge and the fluid outlet port of the housing. The deformable strips align the end members and the sleeve. Upon insertion of the cartridge into the housing, the deformable strips are compressed between the cartridge exterior surface and the housing to isolate the first path from the second path. Advantageously, the seal provided by the deformable strips eliminates internal leakage while aligning the cartridge parts.

19 Claims, 7 Drawing Sheets

STATIC SEAL FOR ROTARY VANE CARTRIDGE PUMP ASSEMBLY

FIELD OF THE INVENTION

The invention relates to rotary vane pumps and more particularly to arrangements for mounting a multi-part cartridge rotary vane pump in a housing.

BACKGROUND OF THE INVENTION

Positive displacement rotary vane pumps widely used in post mix soft drink dispensers and espresso coffee machines generally employ a multi-part carbon graphite cartridge as the working part of the pump that is inserted in a metal housing. In such carbon graphite cartridge pumps, internal leakage between the fluid inlet and the fluid outlet in the housing depends entirely on a close fit between the housing and the cartridge. The clearance between the cartridge and housing of a new pump is less than 0.001 inch. Such clearance, however, creates a leak path between the inlet and outlet with resultant internal leakage. Less clearance makes assembly difficult unless costly and time consuming machining methods are used. More clearance would be beneficial to allow thermal expansion and contraction to lessen the chances of cracking of the carbon graphite and to lessen the possibility of inducing a radial pre-load on one or more of the three shaft bearings. Such clearance, however, would result in unacceptable leakage.

In order to compensate for the internal leakage, cartridge rotary vane pump cartridges for drink and espresso dispensing machines have been designed to operate at a higher flow rate. For example, if the desired pump output is 100 gallons per hour at 100 psi, the pump may designed for 103 gallons per hour to compensate for internal leakage. As a result, a newly manufactured 100 gph pump will lose 3 percent of it performance due to internal leakage. If the desired pump output is 30 gallons per hour at 100 psi, the pump is designed for 33 gallons per hour to compensate for internal leakage. Accordingly, a newly manufactured 30 gph pump will lose 10 percent of it performance due to internal leakage.

U.S. Pat. No. 3,583,838 issued to S. Stauber Jun. 8, 1971 discloses a rotary displacement pump in which an elastic sleeve is disposed in the interior of a housing. The elastic sleeve has sealing strips at the edges and a crosspiece disposed between the suction and the delivery sides of the pump. The crosspiece is an extension of the elastic pump sleeve along an axial line that is inserted into a groove in the housing between the housing inlet and the housing outlet. The crosspiece is structured as a pair of lip sealing elements joined at the surface of the sleeve and arranged so that only one of the lips is pushed away from the housing groove by pressure acting on one side while the other lip functions as a seal.

U.S. Pat. No. 3,966,369 issued to Marion A. Garrison Jun. 29, 1996 discloses a sealing arrangement isolating the inlet ports from the outlet ports of a single part, rigid fluid driven motor cartridge mounted in a rigid housing. A sinuous deformable element is positioned between the outer surface of the pump cartridge and the inner surface of the housing for sealing. The sinuous element, however, does not contact the end portions of the cartridge and does not provide any alignment function.

U.S. Pat. No. 5,411,386 issued to Paul W. Huber et al. May 2, 1995 discloses an air driven random orbital sander in which opposing end portions mount a rigid multi-part motor cartridge into position inside a rigid housing. The resiliently deformable elements extending from the opposing end portions are interlinked to provide an axial seal that separates the air inlet of the assembled motor from the air outlet. The resiliently deformable elements between the outer surface of the motor cartridge and the inner surface of the housing provide a resilient mount for air the motor cartridge. As a result, a separate alignment pin is required to be inserted in the parts of the motor cartridge.

U.S. Pat. No. 3,193,190 issued to P. G. Lindberg Jul. 6, 1966 discloses a rigid multi-part vacuum pump that is mounted in a rigid housing. The inlet port of the housing is axially displaced from the outlet port of the housing and an O ring is mounted in an annular flange extending from the outer surface of the pump at an axial position between the axial positions of the inlet and outlet ports to sealingly separate air entering the inlet port from air exiting the outlet port. The O ring seal in an annular flange may provide isolation of axially displaced inlet and outlet ports. In systems such as drink dispensers, however, there is not sufficient space for axially displaced inlet and outlet ports and the limited space only permits use of axially aligned ports. Accordingly, neither separation of axially aligned inlet and outlet ports nor alignment of pump parts can be obtained by an O ring in an annular flange.

The seal structures of the aforementioned patents do not provide a seal between axially aligned inlet and outlet ports of a rigid multi-part rotary vane pump while providing alignment of the parts of the pump cartridge.

BRIEF SUMMARY OF THE INVENTION

The invention is directed to a rotary vane type pump having a housing with axially aligned inlet and outlet ports. A cartridge insertable in the housing has a sleeve enclosing a rotatable vaned shaft and opposing end members that support the rotatable vaned shaft. A fluid inlet to the vaned shaft is formed on a first side of the cartridge and a fluid outlet from the vaned shaft is formed on a second side of the cartridge. When the cartridge is inserted in the housing, a first fluid path is provided between the inlet port of the housing and the fluid inlet of the cartridge and a second fluid path is provided between the fluid outlet of the cartridge and an outlet port of the housing.

According to the invention, a pair of grooves extend axially across the outer surface of the sleeve and correspondingly positioned grooves extend axially across the outer surface of each end member. The grooves are positioned to separate the first side from the second side. A first elastically deformable member is inserted in one of the axially extending grooves to contact the inner surface of the housing between the inlet port and the outlet port and a second elastically deformable member is inserted in the other axially extending groove to contact the inner surface of the housing. The inserted elastically deformable members align each end member with the sleeve and isolate fluid flow from the inlet port to the fluid inlet from fluid flow from the fluid outlet to the outlet port.

According to one aspect of the invention one of the pair of grooves extends along a first line separating the housing inlet and the housing outlet and the other groove extends along a line opposite the first line on the outer surfaces of the sleeve section and the end members.

According to another aspect of the invention, the elastically deformable member is compressed between the bottom of the groove and the inner surface of the housing.

According to yet another aspect of the invention, the elastically deformable member elastically deforms during the operation of the pump.

According to yet another aspect of the invention, the elastically deformable member is a strip element of having a first edge that contacts the bottom of the groove, a second edge overlying the first edge that contacts the inner surface of the housing and a portion joining the first and second edges positioned in the inlet port side of the groove.

According to yet another aspect of the invention, the first edge presses against the bottom of the groove and the second edge presses against the inner surface of the housing when the cartridge is inserted into the housing.

According to yet another aspect of the invention, the strip element is a metal element.

According to yet another aspect of the invention, at least a portion of the outer surface of the metal strip element is separated from the groove and the inner surface of the housing by a non-metallic material.

According to yet another aspect of the invention, the metal element is stainless steel.

According to yet another aspect of the invention, a first portion of the metal strip outer surface presses against the bottom of the groove and a second portion of the metal strip outer surface presses against the inner surface of the housing in response to the pressure difference between the housing outlet port and the housing inlet port during operation of the pump.

In an embodiment illustrative of the invention, a carbon graphite cartridge has a sleeve enclosing a shaft from which carbon graphite vanes extend and disk shaped ends rotatably supporting the shaft. A fluid inlet is formed between the sleeve and each end on one side of the cartridge and a fluid outlet is formed between the sleeve and each end on the other side of the cartridge. Each of a pair of slots extends axially across the outer surface of the sleeve and ends between the first and second cartridge sides and a stainless steel strip having first and second overlaying sections is inserted into the slot so that the first section of the strip contacts the bottom of the slot. The inserted stainless steel strips align the sleeve with the ends.

When the cartridge is inserted into a housing having axially aligned inlet and outlet ports, one slot is positioned between the inlet and outlet ports. The second section of each strip contacts the inner surface of the housing and the joint between the first and second sections is on the fluid inlet side of the cartridge so that the fluid path from the inlet port of the housing to the fluid inlet of the cartridge is sealed from the fluid path from the fluid outlet of the cartridge and the outlet port of the housing. In operation, the pressure difference between the fluid outlet and the fluid input path causes the stainless steel strip to press against the inner surface of the housing and the bottom of the slot.

Further features and advantages of the invention will be made apparent from the following detailed description and the accompanying drawings.

DETAILED DESCRIPTION

Figure 1:
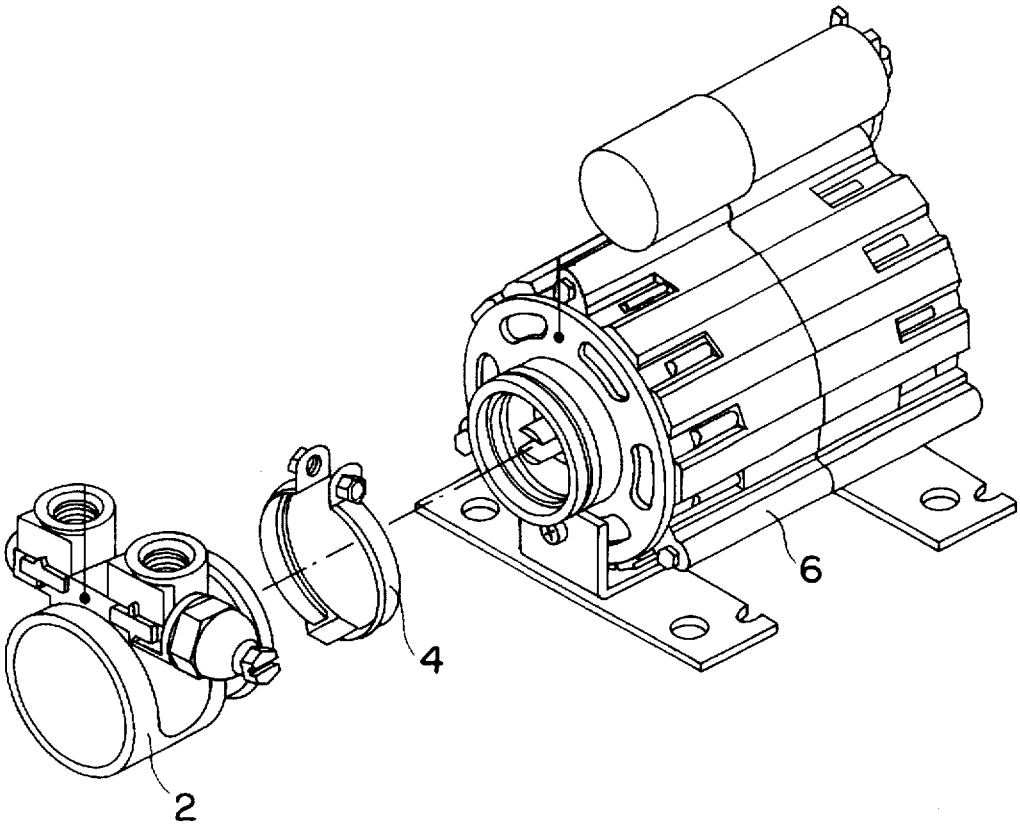
FIG. 1 PRIOR ART
FIG. 1 is a trimetric view of a prior art pump and a driving motor.

FIG. 1 shows a pump 2 and motor 6 fastened together by a v-band clamp 4 as in the prior art. By way orientation, the pump 2 is generically known as a carbonator pump, and the motor 6 is generically known as a carbonator motor Such carbonator pumps and motors are manufactured in large quantities for use in post mix soft drink dispensers, e.g. Coca Cola fountain dispenser used in restaurants and convenience stores. Carbonator pumps and motors are commonly used in espresso coffee machines, reverse osmosis water purifiers and welding torch coolers. The present design has been manufactured in its present form for over forty years. The pump 2 and motor 6 have mating shafts and mating mounting flanges. The mounting flanges are bound together by v-band clamp 4. The pump 2 is of the rotary vane, positive displacement type suitable for water service. The pump 2 is of the type manufactured by Fluid-o-Tech, Procon, Nippon Oil Company, NUERT, GOTEC and others and is available with numerous flow rates and optional features.

Figure 2:
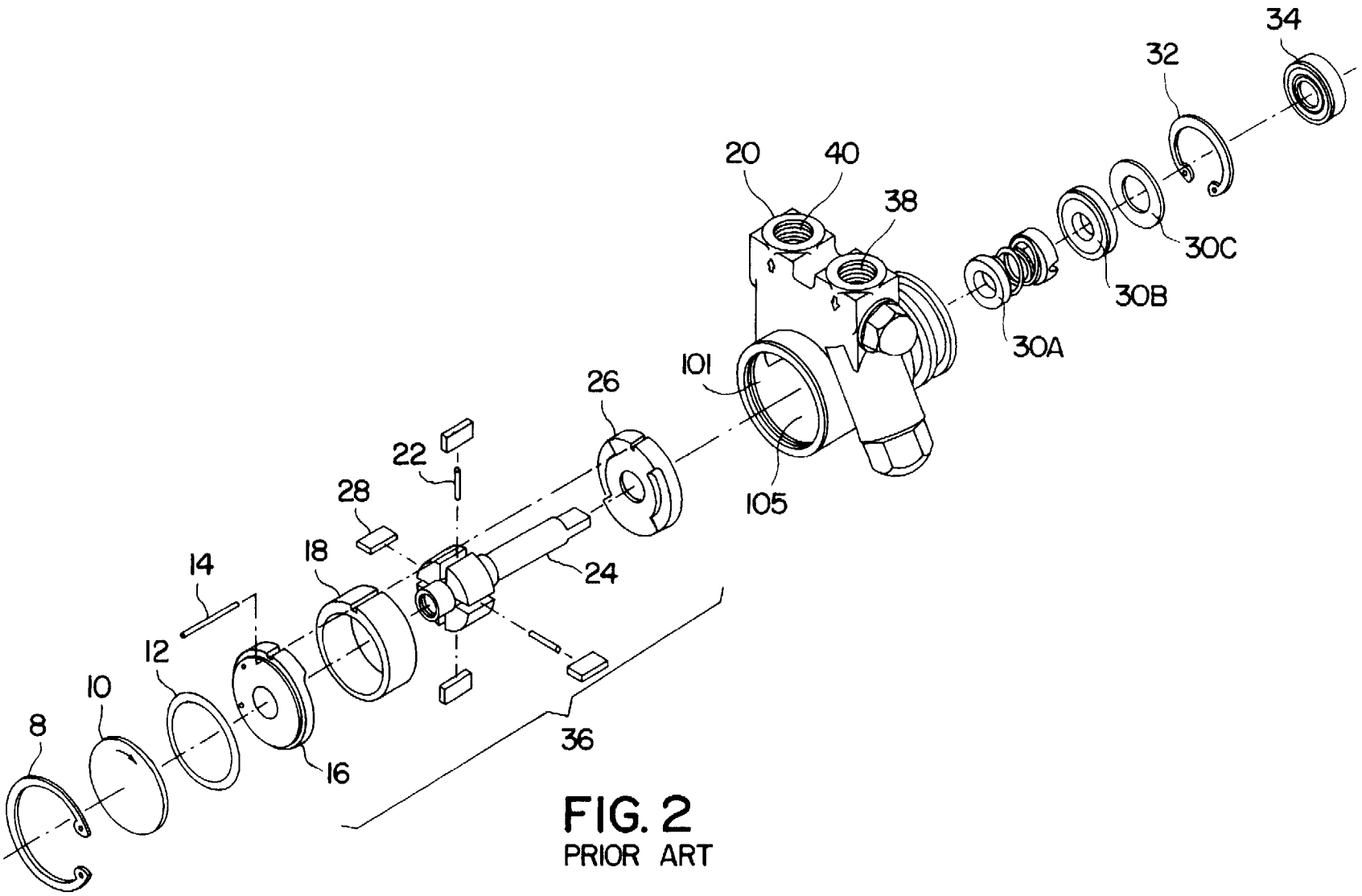
FIG. 2 PRIOR ART
FIG. 2 is an exploded trimetric view of a prior art carbon graphite pump cartridge and rotor with only end seals.

FIG. 2 shows an exploded trimetric view of the most commonly manufactured version of pump 2 in the prior art. Referring to FIG. 2, a nameplate snap ring 8 retains a nameplate 10 when snapped into a groove 101 in a large bore 105 of a housing 20. The nameplate 10 and nameplate gasket 12 is a boundary between the wet pump interior and dry exterior. A carbon graphite front bearing or end 16, a carbon graphite liner or sleeve 18, a carbon graphite rear bearing or end 26, carbon graphite vanes 28, stainless steel vane pins 22, and a stainless steel rotor 24 cooperate to form a cartridge 36. The cartridge 36 occupies a cavity formed by the large bore 105 in the housing 20 and the nameplate 10. The cartridge 36 is held in place by friction and mechanical interlock. An alignment pin 14 occupies a groove in the front bearing 16, the liner 18 and the rear bearing 26 and maintains their relative orientation through mechanical interlock. A spring loaded carbon graphite disk 30A, a ceramic disk 30B, and a backing washer 30C forms a mechanical shaft seal and a boundary between the wet pump interior and dry exterior. The shaft seal 30A, 30B, 30C is retained in a small housing bore (not shown) by seal snap ring 32. A ball bearing 34 is pressed into the end of the small bore of the housing 20. A rotor 24 is supported by the three bearings 16, 26 and 34. A shaft of the rotor 24 extends through the shaft seal 30A, 30B, 30C and the bearing 34 to engage the motor 6. An inlet 38 and outlet 40 provide the entry and exit for the pumped fluid. The bearing 16, the liner 18 and the bearing 26 are positioned radially by close fit in the large bore of housing 20. The bearing 16, the liner 18 and the bearing 26 are positioned axially with zero clearance by the bottom of the large bore on one end and by the compressed gasket 12 on the other. A small clearance exists between the outside diameter of the cartridge 36 and the inside diameter of the housing 20.

Figure 3:
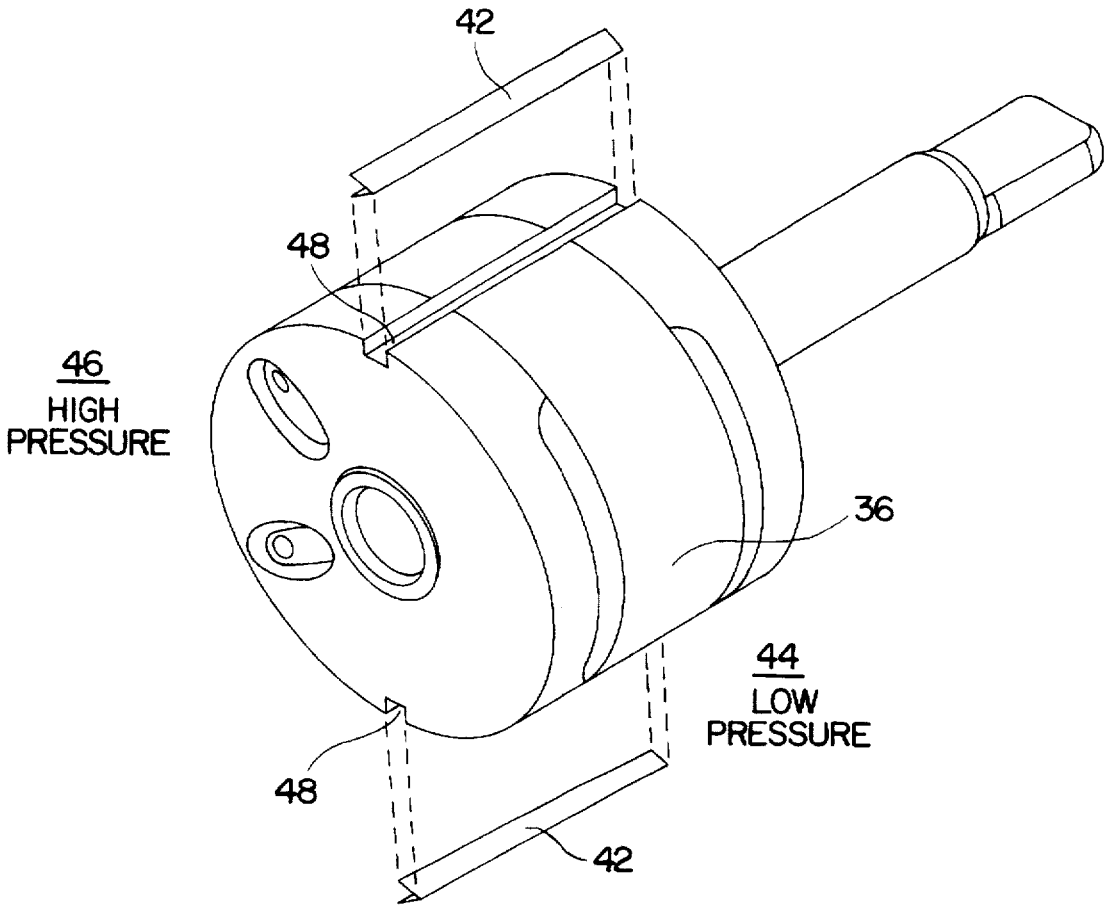
FIG. 3 is a perspective view of a carbon graphite pump illustrative of the invention.

FIG. 3 shows a trimetric view of the cartridge 36 that illustrates the invention using seals 42 and slots 48. The seals 42 perform the function of alignment so that the alignment pin 14 is no longer needed. The seals 42 are located between a low pressure side 44 of the pump cartridge 36 and the high pressure side 46. While other locations may be used, the locations of the seals 42 near the 12 o'clock and 6 o'clock positions and clear of the ports is preferable. Alternatively, the seals may be located at the thick parts of the liner or sleeve (e.g., 4 o'clock position in FIG. 2). Slots 48 are equal in length to the distance between the bottom of the large bore of the housing and the nameplate gasket 12 when assembled. The seals 42 are equal to the slot length. When installed, the seals 42 will touch the bottom of the housing bore on one end and the nameplate gasket 12 of FIG. 2 on the other one edge of the seal 42 will touch the bottom of the slot across its length. The other edge of the seal 42 will touch the large bore of the housing 20 across its length. Seals 42 have an installed orientation with the interior surface of the seal facing the high pressure side 46 and the exterior surface facing the low pressure side 44. The surface finish of the slot may be similar to the surface finishes of the other carbon graphite surfaces. Preferably, the width and depth of the slot are 0.100 inches by 0.040 inches. Other widths and depths will work within limits. For example, there is no motivation to make the width smaller than 0.030 nor larger than 0.35 inches. There is no motivation to make the depth smaller than 0.010 nor larger than 0.15 inches.

Figure 4:
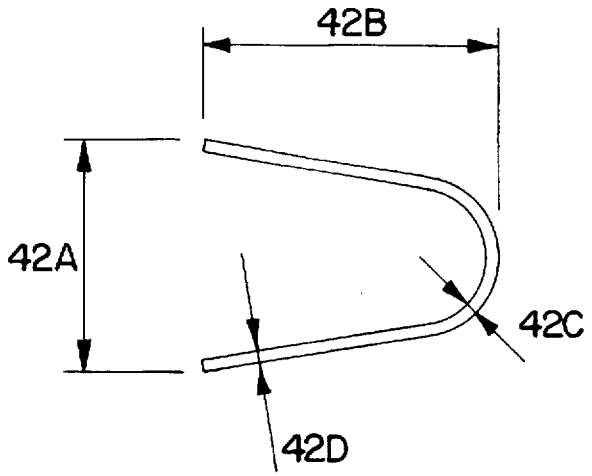
FIG. 4 is a more detailed side view of the seal element of the carbon graphite pump cartridge of FIG. 3.

FIG. 4 shows a front view of seal 42. The preferred seal thickness of seal 42 is 0.003 inch and the preferred material is stainless steel. The preferred fabrication technique is folding a burr-free piece of shim stock. The uninstalled, preferred seal depth 42A is 0.050 inches and the preferred seal width 42B is 0.090 inches, nominal. The preferred radius 42C is 0.012 inches. The cross sectional shape of seal 42 is closer to a "U" than a "V" shape. Other material thicknesses, depths and widths will work within limits. There is no motivation to use stainless steel thinner than 0.001 inches nor thicker than 0.020 inches. The dimensions of the seal cannot exceed those of the slot whose dimensions have been previously described. However, the seal can be smaller than the slot.

Figure 5:
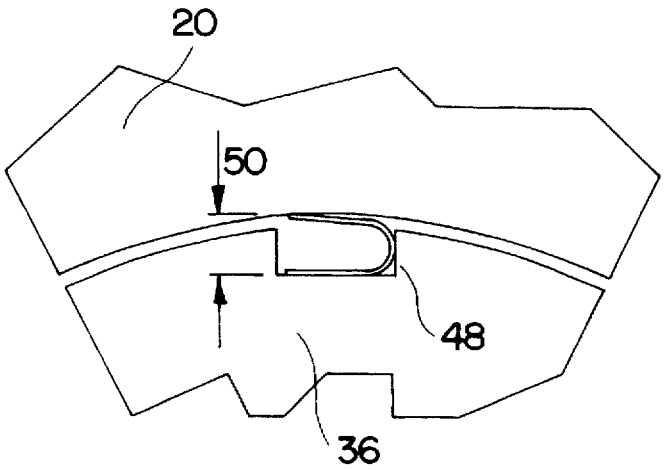
FIG. 5 is a schematic front cross-section view of the seal element of FIG. 3 in position when the carbon graphite pump cartridge is inserted into a housing.

FIG. 5 shows a detailed diagram of the seal 42 installed in the cavity formed by the slot 48 and large bore of the housing 20. The installed seal depth 50 is reduced during installation to the slot depth of 0.040 inches from 0.050 inches. Because of the springiness of stainless steel, the edges of the seal press the bottom of the slot on one side and the bore of the housing on the other side.

Figure 6:
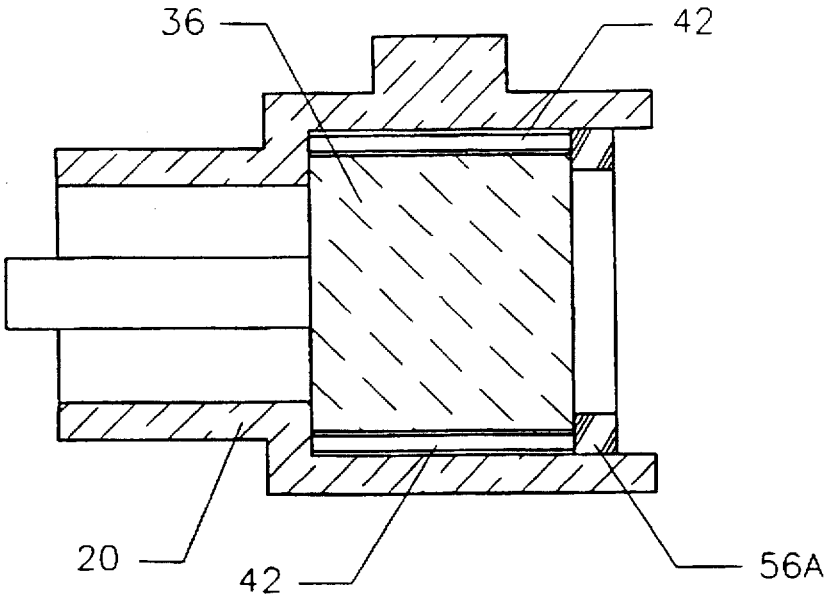
FIG. 6 is a side cross-sectional view of the carbon graphite pump cartridge of FIG. 3.

FIG. 6 shows an installed detailed view of the seal 42 and a gasket 56A. The cross section of gasket 56A is square rather than circular. Gasket 56A is preferable to an o-ring gasket because of its full end contact on the seal 42 which effects a more perfect seal.

Figure 7A:
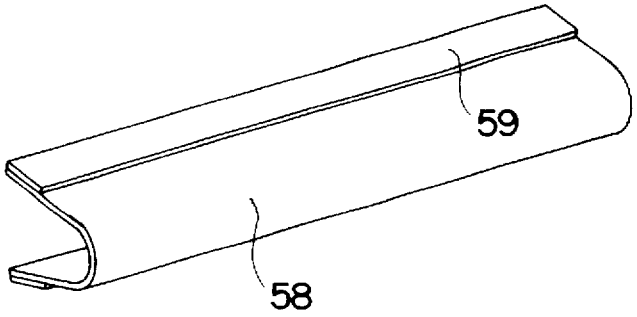
FIGS. 7A–7F illustrate different forms of the seal element of FIG. 3.
Figure 7B:
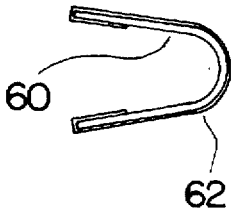
Figure 7C:
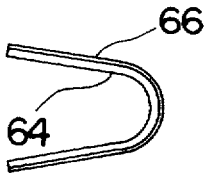
Figure 7D:
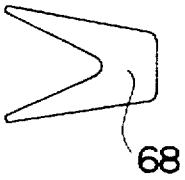
Figure 7E:
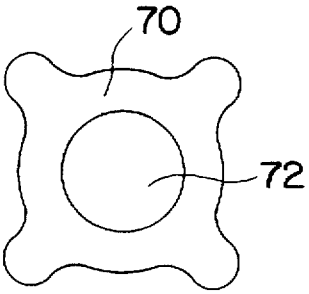
Figure 7F:
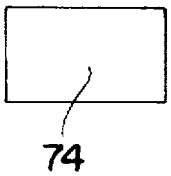

FIG. 7A–7F show several alternate embodiments for the seal 42 to occupy the slot cavity of groove 48. A seal 58 shown in FIG. 7A has an elastomer gasket 59 bonded to the exterior edges. A seal 60 shown in FIG. 7B has a Teflon tape 62 draped over its exterior surface. A seal 64 shown in FIG. 7C has a polymer coating 66 applied to its exterior surface. A seal 68 shown in FIG. 7D is made from a polymer, e.g., nylon, ryton, teflon or equivalent generic compounds. A seal 70 shown in FIG. 7E is made an elastomer, e.g., nitrile, viton bonded to reinforcement 72, e.g., stainless steel, monel and a seal 74 shown in FIG. 7F is made of an elastomer which can formed to interlock with the slot 48 or bonded to the slot 48.

Figure 8:
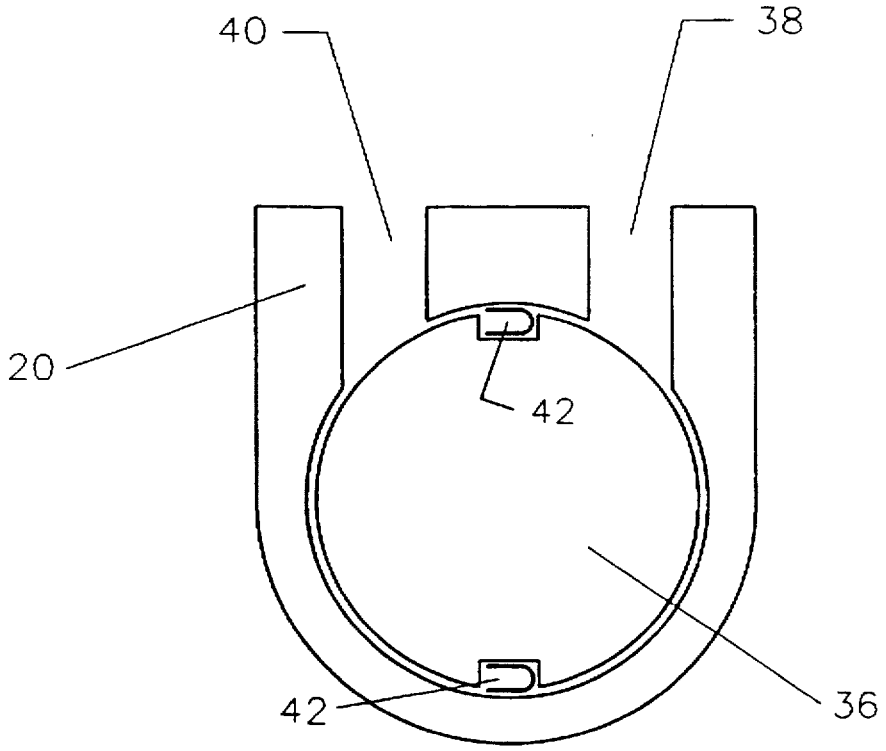
FIG. 8 is a schematic front cross-sectional of a carbon graphite pump cartridge in a housing illustrative of the invention.

FIG. 8 is front cross-section view schematically illustrating the leakage path between the cartridge 36 and the housing 20. Without seals 42 of the invention, there is no barrier between the low pressure zone 46 (inlet port 38) and the high pressure zone 48 (outlet port 40). Undesirable fluid flow from the high pressure zone to the low pressure zone between the cartridge and housing can represent from 2 to 10 percent of the output flow of a new pump. The fact that it is not more is due to the close fit between the cartridge and housing. The interior diameter of the large housing bore exceeds the outside diameter of the cartridge by only 0.001 inch, approximately. According to the invention, the seals 42 provide a barrier to this flow. As described, an initial seal is formed when the edges are compressed against the housing and cartridge during installation. When the pump is operating, the seal is further developed as the high pressure zone forces the seal edges more tightly against the housing and cartridge. The shape of seal 42 is self-actuating under pressure. The seals are of a material and shape to elastically deform under normal operating pressure. Depending on the embodiment, the seal is a bubble tight barrier.

From the foregoing description, it should be apparent that the seals of this invention provide distinct and unexpected advantages. The seals substitute for the alignment pin yet provide much greater utility. Therefore the additional cost (if any) is minimal. Assembly procedures remain the same. The seals are backwardly compatible with the huge installed base. Since the seal is compact in cross section, its slot in the carbon graphite will be commensurately small. Thus, the seal will have insignificant impact on the strength of the carbon graphite.

Since it is industry practice to replace the carbon graphite components during remanufacturing, existing pumps can be easily upgraded at little or no cost. The performance improvement is even more dramatic with existing pumps compared to new pumps because of the greater internal leakage. Most of the used pumps scrapped during the remanufacturing process (over 30 percent) because of excessive internal leakage are now reusable because of the seal of this invention. Great effect is gained with surprising little effort and material.

Since a close fit between the carbon graphite cartridge and housing is no longer necessary for leakage control, the allowable clearance can be greater; a 0.003 inch clearance presents no problem with the seal of this invention. For new pump production, the greater clearance means increased machining tolerances with a corresponding reduction in machining costs. It may allow alternative materials and manufacturing methods. For example, it may now be possible to use an injection molded housing as molded with little or no machining operations. For pump rebuilding, the greater clearance means the percentage of pumps scrapped will decrease from approximately 30 percent to 5 percent at great savings to major pump users. Used pumps often have excessive clearance from erosion of the brass housing.

Although the evidence is not yet conclusive, erosion of the brass housing appears to greatly shorten the service life of rotary vane pumps. Erosion increases the clearance between the housing and cartridge and increases the internal leakage. Pump output under pressure drops precipitously resulting in removal of the pump from service. The erosion is initiated and maintained by the leakage from the output port area back to the inlet port area. Another advantage of my seal is that pump degradation due to leakage and erosion is eliminated since it is never allowed to start. Thus the pump performs more consistently during its service life and that service life is longer.

Those skilled in the art will recognize that modifications to the foregoing embodiment may be made without departing from the spirit of the present invention. Alternative embodiments may include elastomer seals of various types. A strip of rubber occupying the seal cavity can work effectively but would require a larger seal cavity. A rubber strip with a circular, square or lobed cross-section is an effective barrier when slightly compressed in the seal cavity. A rubber strip internally reinforced with a metal rod can be installed conventionally by shoving it into the cavity. A multi-part seal may be employed by installing an undersized rubber strip which can be installed conventionally by shoving it into the seal cavity. If such a strip contained a hole, the seal could be expanded by the insertion of an oversized plastic or metal rod. A rubber strip with the feature of mechanically interlocking it with the cartridge would allow simultaneous installation with the cartridge. A seal may be used that is installed into the seal cavity as a liquid that subsequently solidifies. The solidification may take place because of cooling or polymerization depending on the material selected. Accordingly, the foregoing description should not be construed as limiting the scope of the invention, which instead should be measured by reference to the following claims.

What is claimed is:

1. A rotary vane type pump comprising:

a housing having an inlet port and an outlet port, the inlet and outlet ports being axially aligned;

a cartridge insertable in the housing including a sleeve section between first and second end members, the sleeve section enclosing a rotatable vaned shaft supported by the first and second end members;

at least one fluid inlet formed in a surface of a first side of the cartridge and at least one fluid outlet formed in a surface of a second side of the cartridge;

a pair of grooves each extending axially across an outer surface of the sleeve section and axially across an outer surface of each of first and second end members in a line, the grooves being radially positioned to separate the first side from the second side; and a first elastically deformable member insertable in one of the axially extending grooves of the sleeve section and the end members to contact an inner surface of the housing between the inlet port and the outlet port and a second elastically deformable member insertable in the other of the axially extending grooves, the first and second elastically deformable members aligning the first end member, the sleeve section and the second end member and isolating fluid flow from the inlet port to the at least one fluid inlet from fluid flow from the at least one fluid outlet to the outlet port.

2. A rotary vane type pump according to claim 1, wherein one of the pair of grooves extends along a first line across the sleeve section and the end members between the housing inlet port and the housing outlet port and the other of the pair of grooves extends along a line opposite the first line on the outer surfaces of the sleeve section and the end members.

3. A rotary vane type pump according to claim 1 wherein the elastically deformable seal member is compressed between a bottom of the groove and the inner surface of the housing.

4. A rotary vane type pump according to claim 1, wherein the elastically deformable seal member elastically deforms during the operation of the pump.

5. A rotary vane type pump according to claim 1 wherein the elastically deformable seal member comprises a strip element having first and second edges and a portion joining the first and edges, the second edge overlying the first edge, the first edge for contacting the bottom of one of the grooves extending across the sleeve section and end members, the second edge for contacting the inner surface of the housing and the joining portion being on an inlet port side of the groove.

6. A rotary vane type pump according to claim 5, wherein the strip element is a metal element.

7. A rotary vane type pump according to claim 6, wherein the metal element is stainless steel.

8. A rotary vane type pump according to claim 6, wherein at least a portion of the outer surface of the first and second edges and the joining portion is separated from the bottom of the groove and the inner surface of the housing by a non-metallic material.

9. A rotary vane type pump according to claim 5, wherein the first edge presses against the bottom of the groove and the second edge presses against the inner surface of the housing when the cartridge is inserted into the housing.

10. A rotary vane type pump according to claim 1, wherein the at least one fluid inlet is formed in a surface of at least one of the first and second end portions on the first side of the cartridge and the at least one fluid outlet is formed in a surface of at least one of the first and second end members on the second side of the cartridge.

11. A pump assembly comprising:

a cylindrical housing having inlet and outlet ports axially aligned in the housing;

a multi-part carbon graphite rotary vane pump cartridge including a vaned shaft in a hollow sleeve member having a cylindrical sidewall and first and second disk shaped end members each having a cylindrical side wall, the shaft being supported by end portions of the first and second end members for rotation and the sidewalls of the end members being held against the sidewall of the sleeve;

each disk shaped end member including a first hollow portion in the end member cylindrical sidewall for fluid flow to the vaned shaft on a first side of the cartridge and a second hollow portion in the end member cylindrical sidewall for fluid flow from the vaned shaft on a second side of the cartridge;

a pair of narrow slots formed all along axial lines in an outer surface of the sidewall of the sleeve member and correspondingly positioned narrow slots formed all along axial lines in outer surfaces of the sidewalls of the end members, the slots separating the first side of the cartridge from the second side of the cartridge; and a first elastically deformable seal member positioned in one of the slots extending in a first line axially across in the first end member, the sleeve member and the second end member to contact an inner surface of the housing between the inlet port and the outlet port and a second elastically deformable seal member positioned in the other one of the slots along a second line extending axially across the first end member, the sleeve member and the second end member to contact the inner surface of the housing, said first and second deformable seal members aligning the first and second end members with sleeve member and sealing a first fluid flow path from the housing inlet port to the first hollow portion from a second fluid flow path from the second hollow portion to the housing outlet port.

12. A rotary vane type pump according to claim 11, wherein one of the pair of slots extends along a first line across the sleeve member and the end members between the housing inlet port and the housing outlet port and the other of the pair of slots extends along a second line opposite the first line on the outer surfaces of the sleeve section and the end members.

13. A rotary vane type pump according to claim 11 wherein each elastically deformable seal member is compressed between a bottom of the slot and the inner surface of the housing.

14. A rotary vane type pump according to claim 11, wherein the elastically deformable seal member elastically deforms during the operation of the pump.

15. A rotary vane type pump according to claim 11 wherein the elastically deformable seal member comprises a strip element having in cross-section first and second sections and a portion joining the first and second sections, the second section overlying the first section, the first section for contacting the bottom of one of the slots extending across the sleeve member and end members, the second section for contacting the inner surface of the housing and the joining portion being on the inlet port side of the groove.

16. A rotary vane type pump according to claim 15, wherein the strip element is a metal element.

17. A rotary vane type pump according to claim 16, wherein the metal element is stainless steel.

18. A rotary vane type pump according to claim 16, wherein at least a portion of the outer surface of the first and second sections is separated from the bottom of the groove and the inner surface of the housing by a non-metallic material.

19. A rotary vane type pump according to claim 15, wherein at least an edge of the first section presses against the bottom of the slot and at least an edge of the second section presses against the inner surface of the housing responsive to a pressure difference between the housing outlet port and the housing inlet port during operation of the pump.

* * * * *